US006305366B1

(12) United States Patent
Rizzo et al.

(10) Patent No.: US 6,305,366 B1
(45) Date of Patent: Oct. 23, 2001

(54) SOFTBALL/BASEBALL TRAINING MACHINE

(76) Inventors: Michael J. Rizzo; Marlene J. Rizzo, both of 27062 Bristol La., Menifee, CA (US) 92584

( * ) Notice: Subject to any disclaimer, the term of this patent is extended or adjusted under 35 U.S.C. 154(b) by 0 days.

(21) Appl. No.: 09/656,181

(22) Filed: Sep. 6, 2000

Related U.S. Application Data

(60) Provisional application No. 60/161,736, filed on Oct. 27, 1999.

(51) Int. Cl.[7] ..... F41B 4/00
(52) U.S. Cl. ..... 124/6
(58) Field of Search ..... 124/6, 78

(56) References Cited

U.S. PATENT DOCUMENTS 3,306,613 * 2/1967 Mainers .
4,372,284 * 2/1983 Shannon et al. ..... 124/78
4,559,918 * 12/1985 Ballerin et al. ..... 124/78
4,583,514 * 4/1986 Nozato ..... 124/78
4,655,190 * 4/1987 Harris ..... 124/78
4,760,835 * 8/1988 Paulson et al. ..... 124/78
4,823,763 * 4/1989 Ponza ..... 124/78
5,046,476 * 9/1991 Nozato ..... 124/78
5,338,025 * 8/1994 Giovagnoli .
5,359,986 * 11/1994 Magrath et al. ..... 124/78
5,437,261 8/1995 Paulson et al. ..... 124/78
5,722,384 * 3/1998 Cox ..... 124/78
5,826,568 10/1998 Van Ross, Jr. ..... 124/6

* cited by examiner

*Primary Examiner*—John A. Ricci
(74) *Attorney, Agent, or Firm*—Richard C. Litman

(57) ABSTRACT

A softball and hardball training machine comprising a single drive unit with an adjustable speed control rotating two pneumatic tires at different RPM's to propel a ball at different speeds for simulating "off-speed" or "change-up" pitches to a student.

6 Claims, 1 Drawing Sheet

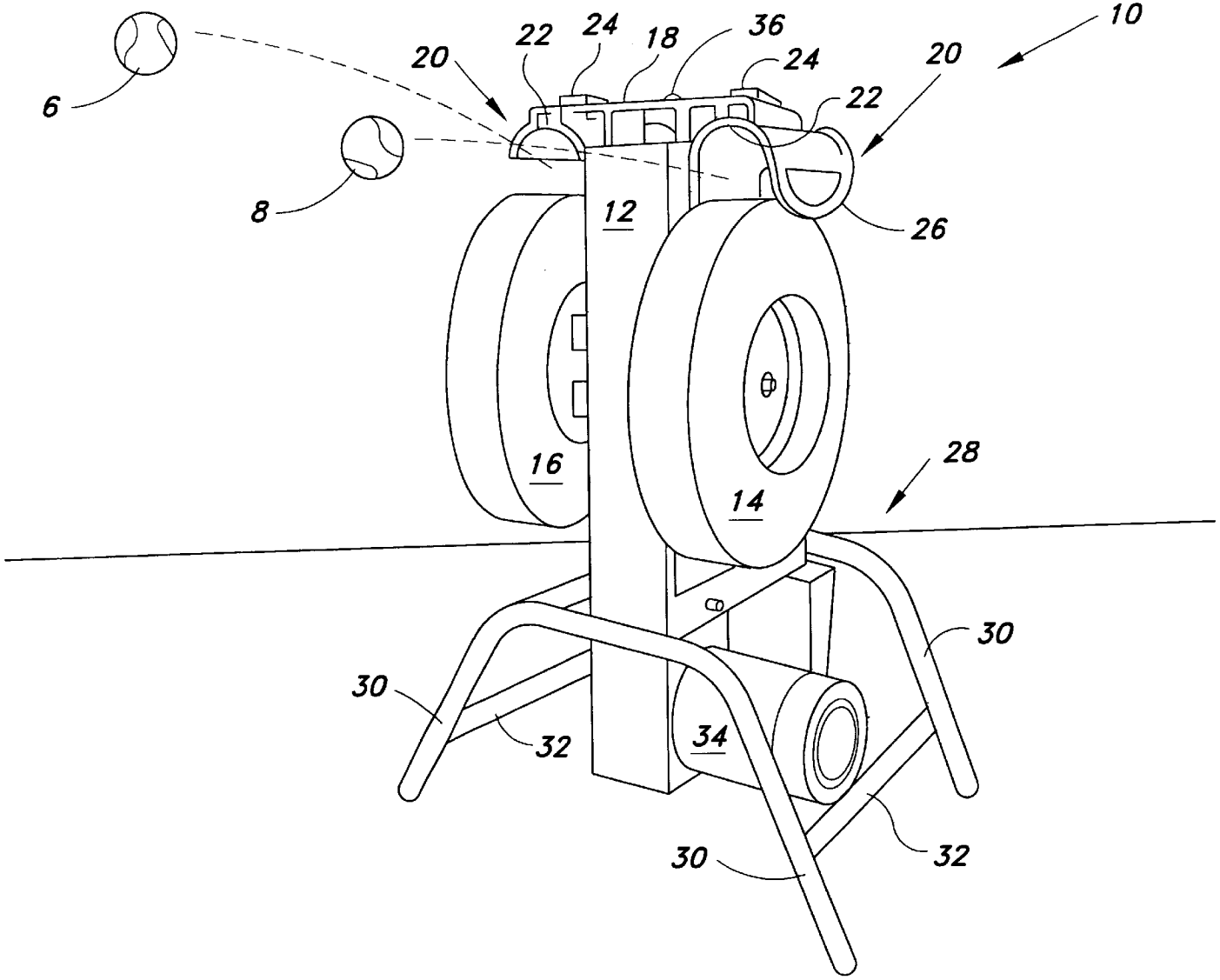
10
20
22
24
36
18
24
22
20
26
28
12
14
16
30
32
34
30
32
30
8
6

SOFTBALL/BASEBALL TRAINING MACHINE

CROSS-REFERENCE TO RELATED APPLICATION

This application claims the benefit of U.S. Provisional Patent Application Ser. No. 60/161,736, filed Oct. 27, 1999.

BACKGROUND OF THE INVENTION

1. Field of the Invention

The present invention relates generally to ball pitching machines. More specifically, the invention is a baseball training machine for the instructional practice of catching or batting a softball or hardball at different speeds and heights, said machine comprising a single drive unit that rotates two pneumatic tires at different RPM's.

2. Description of the Related Art

The relevant art of interest describes various ball throwing machines, but none disclose the present invention. There is a need for an economical ball throwing machine which can pitch a hardball or a larger softball at different speeds and in an overhand or underhand style without stopping for adjustment. The related art will be discussed in the order of perceived relevance to the present invention.

U.S. Pat. No. 5,359,986 issued on Nov. 1, 1994, to Earl K. Magrath, III et al. describes a commercialized coin operated pitching machine system for pitching either softballs or baseballs to a single station, wherein at least one of the pitching machines can have variable speed and height pitches. Separate hoppers and pairs of counter-rotating wheels are provided for the different balls thrown from a single opening in a netting. Four motors are used to operate each wheel, but it is suggested that one motor can drive four wheels through a suitable transmission. The pitching machine system is distinguishable for its integration of separate hoppers feeding separate pairs of ball-throwing wheels and operated by a coin actuated control box.

U.S. Pat. No. 5,826,568 issued on Oct. 27, 1998, to William Van Ross, Jr. describes a softball or baseball pitching and throwing apparatus comprising a metal frame cart or dolly having a pair of rear wheels and a rear handle, and a pair of front legs with cleated feet. The balls are inserted in a feed tube having a propulsion alignment pad comprising either rollers, bearings, tires, foam pads, rubber pads, or metal pads positioned in front of the feed tube. A pneumatic tire is rotated by a gas-powered lawn motor through a belt and pulley system which is clutched for speed control. An angular adjusting arm is controlled by a clamp and handle on the frame. The apparatus is distinguishable for its single propelling tire and the clutched pulley system.

U.S. Pat. No. 4,559,918 issued on Dec. 24, 1985, to Jean-Paul Ballerin et al. describes a ping pong ball-throwing device with ball-throwing heads and ball conveying system which includes a Y-junction housed in an upright box. An air blower supplies air through a duct having vents to control air speed as a ping pong ball is fed proximate the blower to either of two sets of rollers with adjustable gaps operating at different speeds with four individual motors. The pressurized air flow is fed to the rollers by a Y-junction which includes electromagnets for controlling the feeding of ping pong balls to the rollers at the rate of 1–3 balls per second. The device is distinguishable for its limitation to ping pong balls by air propulsion.

U.S. Pat. No. 4,372,284 issued on Feb. 8, 1983, to James A. Shannon et al. describes a baseball-throwing machine capable of pitching curve and slider balls comprising two oppositely rotating pneumatic wheels which are rotated at different speeds by a single DC shunt wound motor. The wheels are driven with one variable drive pulley and an assortment of guide pulleys, wherein one wheel is driven at constant speed while the speed of the second wheel is adjusted by the variable speed pulley. The wheels are mounted horizontally on a Y-shaped frame transportable on a pair of wheels and stabilized by an adjustable jack stand. The machine is distinguishable for requiring two oppositely rotating wheels.

U.S. Pat. No. 4,583,514 issued on Apr. 22, 1986, to Fujio Nozato describes a ball-throwing machine comprising a pair of vertically positioned rotary wheels with a ball feeding tube, a counter-rotating mechanism with an input pulley for rotating the wheels in opposite directions, a gas engine driving an output pulley, and a tripod support with three wheels. The machine is distinguishable for its requirement for two oppositely rotating wheels.

U.S. Pat. No. 4,655,190 issued on Apr. 7, 1987, to Clifford V. Harris describes a ball pitching machine with a selective adjustment between vertically positioned drive and pressure wheels with the smaller pressure wheel on top. The larger drive wheel is driven directly by a 0.5 HP, 2 speed, 110 volt electric motor. The pressure wheel is mounted on an adjustable (in height) A-shaped subframe on a mainframe having a pair of transporting wheels and a handle. The machine is distinguishable for its drive wheel and pressure wheel structure.

U.S. Pat. No. 4,760,835 issued on Aug. 2, 1988, to Kerry K. Paulson et al. describes a ball throwing machine comprising a pair of spaced, resiliently tired wheels pivotally mounted on a base for axial rotation in a common plane. A ball feed chute feeds the ball between the rotating wheels and the top and bottom fingers of an outlet. Electric motors drive each wheel independently and are controlled by a control knob of an electrical control unit. The machine is distinguishable for its requirement for two wheels to throw a ball.

U.S. Pat. No. 4,823,763 issued on Apr. 25, 1989, to Larry J. Ponza describes a ball throwing machine comprising a pair of rotating discs supported for rotation and angularly opposed relation so as to laterally engage a ball and to project it. A pair of positioning discs are disposed on the interior ball-contacting surfaces of the flat-faced rotary discs to precisely locate the balls. The machine is distinguishable for its rotating discs and positioning discs.

U.S. Pat. No. 5,046,476 issued on Sep. 10, 1991, to Fujio Nozato describes a support structure for a ball throwing machine comprising a circular frame mounted vertically and pivotally on a U-shaped bracket supported by a tripod. The circular frame supports a pair of opposed wheels driven by individual electric motors and another pair of motor driven opposed wheels aligned around a ball throwing pipe with apertures for contacting the ball. The four separate wheels are rotated at the same speed and arranged in the axial direction of the ball throwing pipe which has a square cross-section. The machine is distinguishable for its four-wheel throwing structure.

U.S. Pat. No. 5,437,261 issued on Aug. 1, 1995, to Kerry K. Paulson et al. describes a tripod based ball pitching device comprising a pair of rotary wheels and a ball feed tube mounted between them and on adjustable support components to vary the horizontal and vertical positions of delivery to a batter. The wheels are rotated individually by electric motors which are controlled by potentiometers, and elevation adjustments are made by electric signal generators. The device is distinguishable for its conventional use of a pair of individually driven counter-rotating wheels.

German Patent Application No. 3,601,188 published on Jul. 23, 1997, for Harald Merkt describes a tennis ball throwing device utilizing a cylindrical chute with a roller rotated by an electric motor on an arm attached to the chute. The chute has attachable directional guides to impart different ejection routes for the projected tennis ball. The device is distinguishable for its single roller for throwing a tennis ball.

U.K. Patent Application No. 2,095,565 published on Oct. 6, 1982, for Charles J. Curtayne describes a squash ball ejection machine which feeds squash balls one at a time from a vertical storage pipe to a pair of counter-rotating rollers and a horizontal pipe to eject the squash balls in exactly the same direction a number of times. The machine provides for pre-heating of the squash balls by a cam and microwash. The machine is distinguishable for its conventional use of counter-rotating rollers to throw out the squash balls.

None of the above inventions and patents, taken either singly or in combination, is seen to describe the instant invention as claimed.

SUMMARY OF THE INVENTION

The present invention is directed to a versatile hardball and softball training machine comprising a single drive unit with an adjustable speed control rotating two pneumatic tires at different RPM's to propel the ball at different speeds for simulating "off-speed" or "change-up" pitches and overhand or underhand pitches to a student. Two independent ball feed sources are included on the device (one above each tire), and the tire speeds can be randomly adjusted.

Accordingly, it is a principal object of the invention to provide a hardball and softball throwing, batting and training machine with two independent ball feed sources.

It is another object of the invention to provide a hardball and softball throwing machine which pitches the balls at different predetermined speeds to the student.

It is a further object of the invention to provide a ball throwing machine which can pitch balls overhand or underhand style.

Still another object of the invention is to provide a ball throwing machine with a speed adjustment control for simulating "off-speed" or "change-up" pitches.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

The sole FIGURE is a perspective view of a baseball training machine according to the present invention.

DETAILED DESCRIPTION OF THE PREFERRED EMBODIMENT

The present invention illustrated in the sole FIGURE is directed to a versatile softball 6 and hardball 8 training machine 10 comprising a housing post 12 which supports on opposite sides two pneumatic wheels 14 and 16 which can be conventional mounted vehicle tires with small treads. On top of the housing post 12 a mounting bracket 18 is attached for mounting a ball chute 20 above each wheel. Each ball chute 20 has a curved top element 22 which is secured to an end of the mounting bracket 18 by fasteners 24. At the rear end of each ball chute 20 is a circular ball retainer element 26. Although both softball 6 and hardball 8 are depicted as exemplary, the invention is not to be construed as throwing both balls simultaneously.

The housing post 12 is supported off the ground by a stand 28 comprising four legs 30 braced by two crossbars 32. An industrial grade electric AC motor 34 is mounted at the bottom of the housing post 12 on one side. The two wheels 14, 16 are rotated at predetermined different speeds but with a constant speed difference due to conventional gearing. However, a speed adjustment control 36 is provided on the top of the housing post 12.

Due to the unique two-speed wheels 14, 16, the student can learn to hit (1) balls pitched at different speeds, (2) hardballs or softballs, and (3) underhand (arched) or overhand style (substantially straight-line) pitched balls.

This machine enables the instructor to train a student baseball player to adjust one's timing and coordination to the type of ball pitched and the speed of the pitched ball. The distinct advantage over the prior art machines is the random slow or fast pitching without the instructor taking time to make adjustments on the machine.

It is to be understood that the present invention is not limited to the sole embodiment described above, but encompasses any and all embodiments within the scope of the following claims.

We claim:

1. A softball and hardball training machine comprising:

an upright housing post;

a pair of wheels supported and aligned on opposite sides of the housing post and adapted to rotate at predetermined different speeds by a differential gear means;

a mounting bracket horizontally positioned on the top of the housing post;

said mounting bracket supporting a pair of ball chutes positioned on opposite sides of the housing post;

two pairs of legs supporting a bottom portion of the housing post; and an electric motor mounted on the bottom portion of the housing for rotating the wheels at different predetermined speeds;

whereby an instructor can insert a softball or a hardball in one of the chutes to propel the softball or hardball at predetermined different speeds to a student batter.

2. The softball and hardball training machine according to claim 1, wherein the wheels are pneumatic wheels.

3. The softball and hardball training machine according to claim 2, wherein the pneumatic wheels are small vehicle tires having small treads.

4. The softball and hardball training machine according to claim 1, including the capacity to propel either hardballs or softballs at two predetermined speeds to outfielders.

5. The softball and hardball training machine according to claim 1, wherein a hardball or softball is propelled individually at separate times.

6. The softball and hardball training machine according to claim 1, including a speed adjustable control positioned on top of the housing post for determining a suitable constant speed difference between the pair of wheels.

* * * * *